US007424748B1

(12) United States Patent
McDunn et al.

(10) Patent No.: US 7,424,748 B1
(45) Date of Patent: Sep. 16, 2008

(54) QUICK RELEASE SYSTEM FOR ARMOR PLATES IN A BALLISTIC RESISTANT VEST AND METHOD

(75) Inventors: Todd Robert McDunn, Woodlawn, TN (US); Shane Dwight Woods, St. Louis, MO (US)

(73) Assignee: Eagle Industries Unlimited, Inc., Fenton, MO (US)

( * ) Notice: Subject to any disclaimer, the term of this patent is extended or adjusted under 35 U.S.C. 154(b) by 172 days.

(21) Appl. No.: 11/422,364

(22) Filed: Jun. 6, 2006

(51) Int. Cl.
*F41H 5/013* (2006.01)
*F41H 1/02* (2006.01)
*F41H 1/00* (2006.01)

(52) U.S. Cl. ..... 2/2.5; 2/102; 89/36.05; 428/911

(58) Field of Classification Search ..... 2/2.5, 2/102; 89/36.05; 428/911
See application file for complete search history.

(56) References Cited

U.S. PATENT DOCUMENTS

| | | | | |
|---|---|---|---|---|
| 761,113 A | | 5/1904 | Van Wagoner et al. | |
| 842,498 A | | 1/1907 | Schmidt | |
| 1,776,044 A | | 9/1930 | Roehm | |
| 2,148,152 A | | 2/1939 | Dosberg | |
| 2,343,142 A | | 2/1944 | Freedman | |
| 2,442,895 A | | 6/1948 | Hill | |
| 2,654,964 A | | 10/1953 | Stoll | |
| 3,934,848 A | * | 1/1976 | Snyder | 244/151 A |
| 4,044,478 A | | 8/1977 | Girard | |
| 4,117,609 A | * | 10/1978 | Helt | 36/4 |

(Continued)

FOREIGN PATENT DOCUMENTS

| | | |
|---|---|---|
| CA | 642244 | 6/1962 |

OTHER PUBLICATIONS

Figures A1-A6 illustrate the DAP vest discussed in the background of the subject application. The vest shown has an ID tag claiming a manufacture date of 1990 and denotes the vest as Model A1-IIIA and named A1-TAC-DPSO. Figures A1-A6 show the vest from the front side. Figure A1 shows the cable in the retaining loops closing the armor pocket. Figure A2 shows the cable removed and the loops out of their grommets. Figure A3 shows the cable removed and the loops out of their grommets. Figure A4 shows the vest with the cable installed and the closure flap.

(Continued)

*Primary Examiner*—Gary L. Welch
*Assistant Examiner*—Bobby H Muromoto, Jr.
(74) *Attorney, Agent, or Firm*—Husch Blackwell Sanders LLP

(57) ABSTRACT

A quick release system for releasing armor plates from a vest or other garment including a pocket associated with the front torso portion of the vest for selectively receiving a first armor plate, a pocket associated with the rear torso portion of the vest for selectively receiving a second armor plate, and a flexible retainer element in conjunction with at least one connector element associated with each of the front and rear pockets for selectively retaining the first and second armor plates therewithin, pulling the flexible retainer element releasing the armor plates from their respective pockets. A release handle is located on the front of the vest and is attached to the retainer element for facilitating pulling of the retainer element to release the front and rear armor plates in one easy motion.

5 Claims, 10 Drawing Sheets

U.S. PATENT DOCUMENTS

| | | | | |
|---|---|---|---|---|
| 4,262,865 | A | 4/1981 | Smith | |
| 4,497,069 | A * | 2/1985 | Braunhut | 2/2.5 |
| 4,545,773 | A | 10/1985 | Evert | |
| 4,637,075 | A * | 1/1987 | Ingrisano et al. | 2/94 |
| 4,697,285 | A | 10/1987 | Sylvester | |
| 5,060,314 | A * | 10/1991 | Lewis | 2/2.5 |
| 5,259,093 | A * | 11/1993 | D'Annunzio | 24/3.9 |
| 5,495,621 | A | 3/1996 | Kibbee | |
| 5,512,348 | A * | 4/1996 | Mazelsky | 428/102 |
| 5,516,234 | A | 5/1996 | Duchesne | |
| 5,724,707 | A | 3/1998 | Kirk et al. | |
| 5,785,011 | A | 7/1998 | Gitterman, III | |
| 5,806,740 | A * | 9/1998 | Carlson | 224/628 |
| 5,897,468 | A | 4/1999 | Lumpkin | |
| 5,966,747 | A | 10/1999 | Crupi et al. | |
| 6,029,270 | A * | 2/2000 | Ost et al. | 2/2.5 |
| 6,035,452 | A * | 3/2000 | Braxton | 2/455 |
| 6,098,196 | A * | 8/2000 | Logan | 2/2.5 |
| 6,132,142 | A * | 10/2000 | Carmichael | 405/186 |
| 6,164,048 | A * | 12/2000 | Rhodes | 54/1 |
| 6,185,738 | B1 * | 2/2001 | Sidebottom | 2/2.5 |
| 6,308,334 | B1 | 10/2001 | Maas | |
| 6,421,833 | B2 * | 7/2002 | Khanamirian et al. | 2/69 |
| 6,558,082 | B1 * | 5/2003 | Courtney et al. | 405/186 |
| 6,712,557 | B1 * | 3/2004 | Carmichael | 405/186 |
| 6,769,137 | B2 * | 8/2004 | D'Annunzio | 2/102 |
| 6,948,188 | B2 * | 9/2005 | D'Annunzio | 2/102 |
| 6,986,164 | B1 * | 1/2006 | Morales | 2/94 |
| 7,020,897 | B2 * | 4/2006 | Johnson | 2/102 |
| 7,047,570 | B2 * | 5/2006 | Johnson | 2/102 |
| 7,243,376 | B2 * | 7/2007 | Johnson | 2/102 |
| 7,254,841 | B1 * | 8/2007 | Nelson et al. | 2/102 |
| 2005/0223466 | A1 * | 10/2005 | Jennings et al. | 2/102 |

OTHER PUBLICATIONS

Point Blank Body Armor, Inc., Nato QR Full Spectrum Battle Equipment, Digital Photographs (B1-B8) with details of cable release system using multiple cables taken Jul. 2004.

Digital Photographs C1, C2 and C3 for a Cut Away Vest. Digital Photographs are of a prior art vest. It includes a four cable release system to effect cut away of the vest C1. The shoulder straps each have a cable connection C3 and the sides each have a cable connection C2. The four cable connections are similar in construction. The vest has been referred to as a FSBE I vest.

Digital Photographs D1-D7 for a Cut Away Vest. Digital Photographs show a TAC-VDG vest that went through several design changes, six versions were believed to have been designed. It is not clear which version the illustrated vest is. One version (unknown) which was sold on or about Jun. 18, 2002. Fourteen units of version four were sold on Oct. 20, 2002. The specific design of what was sold is currently unknown. The shoulders were each joined by a respective cable. D2 and the belt or sides and cummerbund were connected by a third cable D3.

Attachments E1-E11 show what is believed to be an M1 flak jacket used in the latter part of World War II by American flyers. This flak jacket utilized a pull cord as seen in Attachment E3 that when pulled separates snaps as seen in Attachments E1 and E2 allowing the flak jacket to fall downwardly off the wearer in the event the wearer needs to ditch the flak jacket in an emergency situation. The flak jacket included armor plates to protect the wearer. Apparently, the armor stayed with the various portions of the flak jacket when the vest was released from the wearer.

Attachments F1-F4 show World War II flak jackets including the M1 flak jacket and the M12. It is not clear from the photos what the construction of the M12 jacket includes. The Attachment F3 appears to show the M1 flak jacket as it would be released from the wearer.

Attachment G1-G10 illustrates a releasable vest apparently produced by Point Blank Body Armor, Inc. Attachment G3 describes the vest as being designed for quick release. Structural details of the vest are not disclosed in the article. There is a reference in Attachment G3 about the vest having a quick ejection hard armor plate pocket.

Attachment H—U.S. Army Natick Soldier Center, USMC Full Spectrum Battle Equipment, website printout (several views of the vest are included). This body armor/vest is believed to be the vest produced by Point Blank Body Armor, Inc. which was referred to in the original Information Disclosure Statement.

Attachment I—Point Blank Body Armor, Inc., Nato QR Full Spectrum Battle Equipment, website printout dated Nov. 5, 2003.

* cited by examiner

QUICK RELEASE SYSTEM FOR ARMOR PLATES IN A BALLISTIC RESISTANT VEST AND METHOD

BACKGROUND OF THE INVENTION

This invention relates generally vests with armor plates and, more particularly, to a quick release system for releasing the armor plates from the vest when necessary.

Ballistic resistant vests often use two or more types of different material to reduce the possibility of injury to the user. For example, some vests use layers or panels of Kevlar® fabric to resist shrapnel and/or some handgun bullets. Other vests use Kevlar fabric in conjunction with auxiliary armor plates to provide more protection to the user. Some armor plates are neutrally buoyant, however, other armor plates, such as ceramic armor plates, are not neutrally buoyant. Some ceramic armor plates that are intended to resist some rifle bullets may weigh from about seven pounds to about nine pounds each. It is common for troops in combat situations to wear a front auxiliary armor plate and a rear auxiliary armor plate which may add considerable weight to the user, depending on the type of armor plate.

The increased weight of non-buoyant armor plates makes it difficult for a soldier or other user of a ballistic resistant vest to swim if they unintentionally fall in the water. In prior art devices, quick release systems have required the user to pull a first release handle connected to a first cable to release the front auxiliary armor plate, and to locate and pull a second release handle connected to a second cable located at the rear of the vest to release the rear auxiliary armor plate. In times of high stress, finding the second release handle has been problematic and time consuming in this prior art device, sometimes called the DAP vest. The release handle in the DAP vest was located proximate the lower edge of the armor plate and a retention cord was also connected to the cable so the cable would not be lost when the release handle was pulled. Photos of the front torso section of the DAP prior art vest are included in an Information Disclosure Statement filed with the present application. In the industry, the interior of a vest is often referred to as the "body" side and is intended to face the body of the user; the opposite side will be referred to as the "impact" side for purposes of this application. In the prior art DAP vest, the cable was located on the impact side of the vest, whereas, in the present invention, a substantial portion of the cable is located on the body side of the vest.

SUMMARY OF THE PRESENT INVENTION

The present invention uses a single cable type member to release the front armor plate and the rear armor plate from the ballistic vest. A release handle is conveniently located on a front torso section near a user's shoulder to allow the user to easily locate the release handle in times of high stress and with a single pull release both the front and rear armor plates.

DETAILED DESCRIPTION OF THE INVENTION

Figure 1:
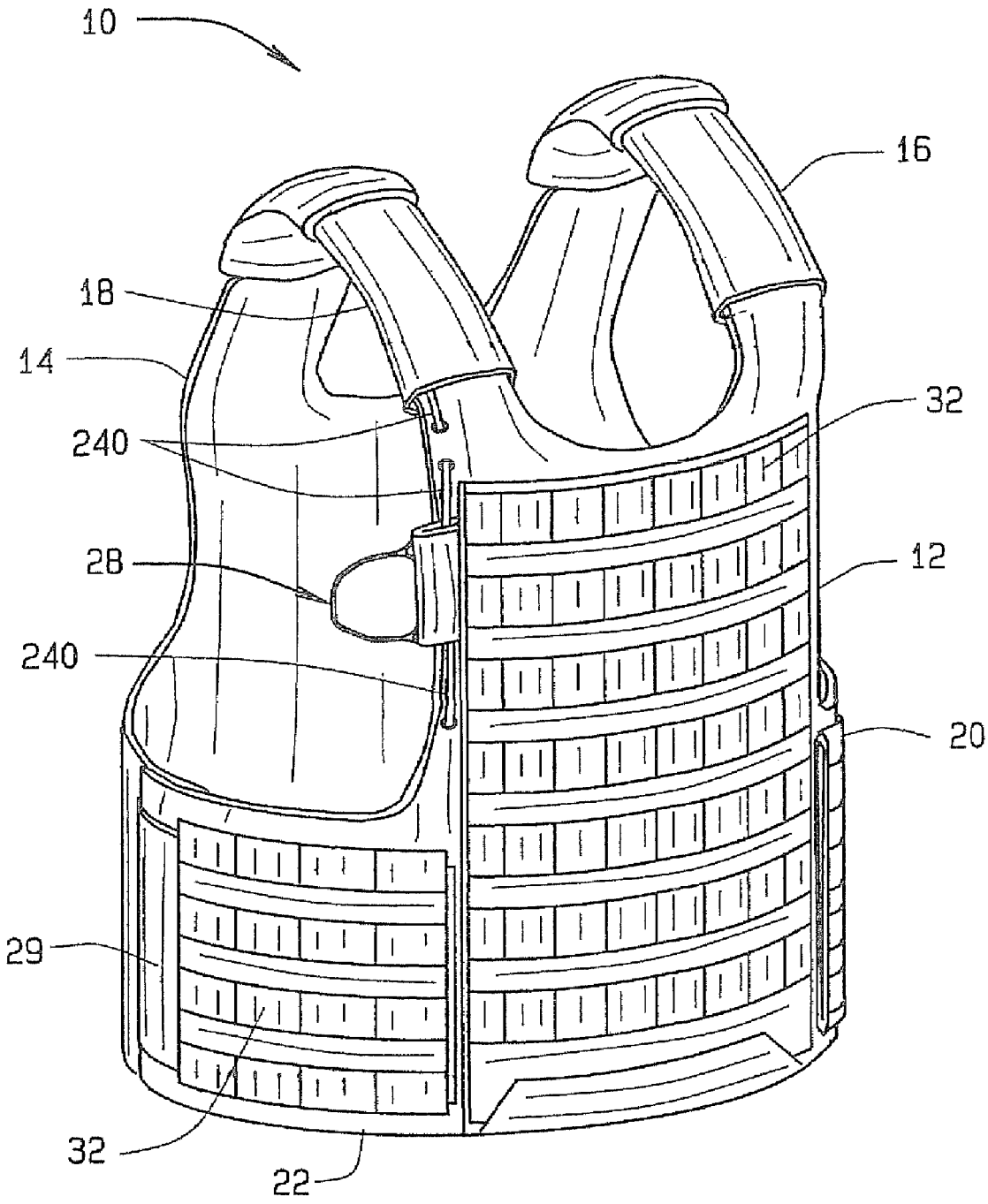
FIG. 1 is a perspective view of the assembled ballistic resistant vest.
Figure 2:
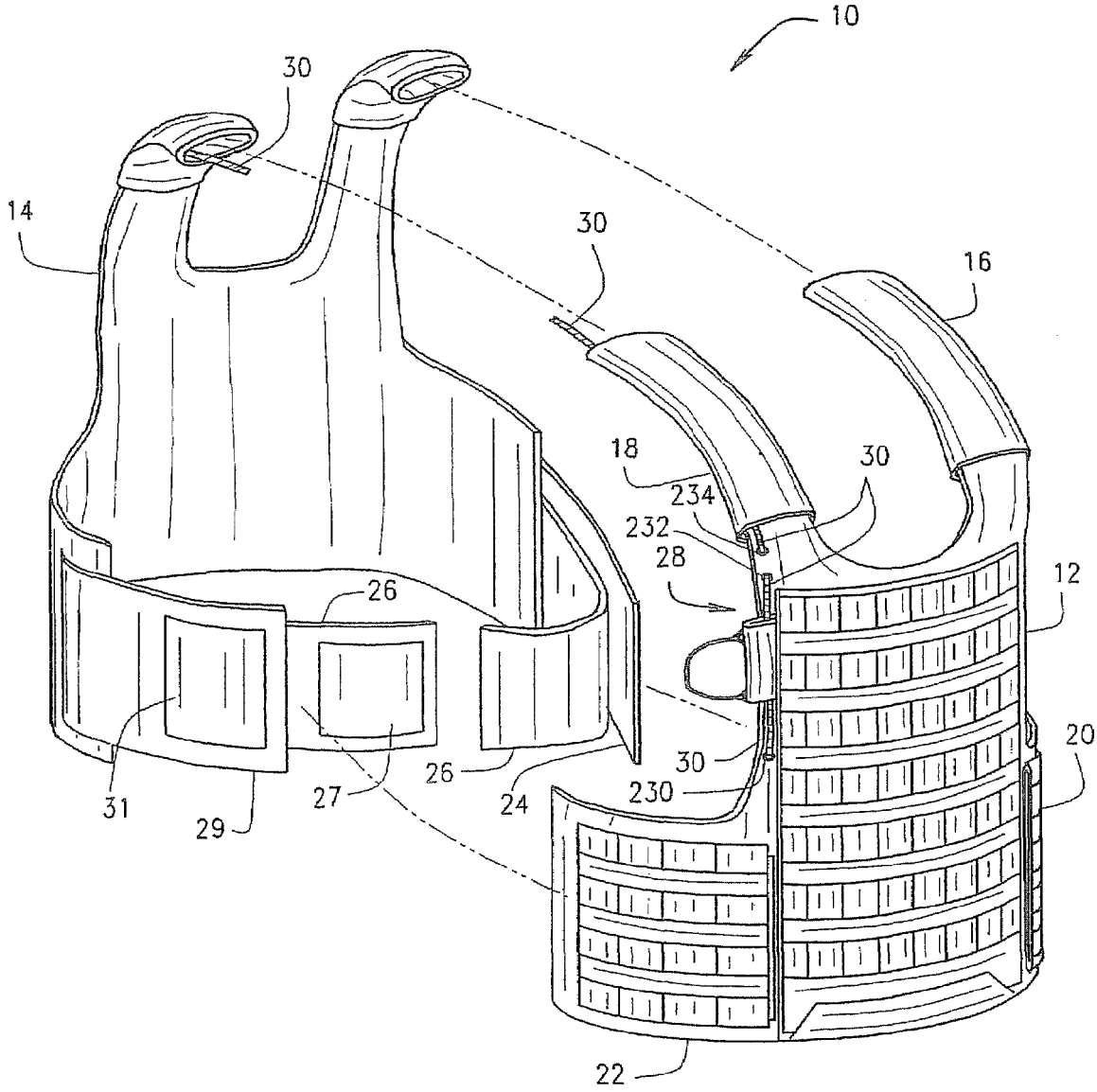
FIG. 2 is a partially disassembled view of the ballistic resistant vest of FIG. 1.

Referring now to FIGS. 1 and 2, a typical vest used in conjunction with the present invention is generally identified by the numeral 10 and includes a front torso section 12 and a rear torso section 14. The front torso section 12 and the rear torso section 14 may include Kevlar® panels, not shown. A left shoulder strap 16 is permanently connected to and extends from the front torso section and engages the rear torso section in a releasable manner. A right shoulder strap 18 is permanently connected to and extends from the front torso section and engages the rear torso section in a releasable manner. As a matter of manufacturing convenience, the shoulder straps could also extend from the rear torso section and engage the front torso section. In yet another design, the shoulder straps could be in two pieces with one piece each being connected to a respective front or rear torso section for releasable connection to each other. A disclosure of a vest of the general type disclosed herein may be found in U.S. Pat. No. 7,020,897. It is also recognized that the shoulder straps may be permanently connected to the front and rear torso sections so as not to be releasable in any fashion.

The vest 10 may include both an outer belt and an inner cummerbund to secure the vest to a user. A left front belt section 20 extends from the front torso section 12 and a right front belt section 22 also extends from the front torso section. A left rear belt section 24 extends from the rear torso section 14 and a right rear belt section 29 also extends from the rear torso section 14. The left front belt section 20 detachably engages the left rear belt 24 and the right front belt section 22 detachably engages the right rear belt section 29. The outer belt ends 24, 29 are securable to the front torso section 12 at the sections 20, 22 respectively with fasteners 31 such as Velcro® fasteners. Opposite distal end portions of the cummerbund 26 may be connected in an adjustable manner with a fastener 27 such as a Velcro® fastener. The purpose of the cummerbund 26 is to keep the ballistic resistant vest close to the user as they move about in active situations, like combat.

The release handle 28 is securely attached to the flexible elongate cable 30. Preferably the cable 30 is a flexible jacketed wire rope. The cable 30 is shown as a single cable member having opposite end portions 82, 182 and an intermediate section 33 to which the handle 28 is preferably secured. The single cable 30 could be a single piece cable, or multiple pieces joined together. The jacket can be flexible clear plastic which is readily available from almost any hardware store. It has been found that a 0.166 inch outside diameter jacketed wire rope is suitable for this application, although larger and smaller diameters may also be suitable. PALS/MOLLE webbing 32 is placed on the exterior of the vest to facilitate attachment of various other pieces of equipment, such as a pistol holster, pouches and other items, not shown.

Figure 6:
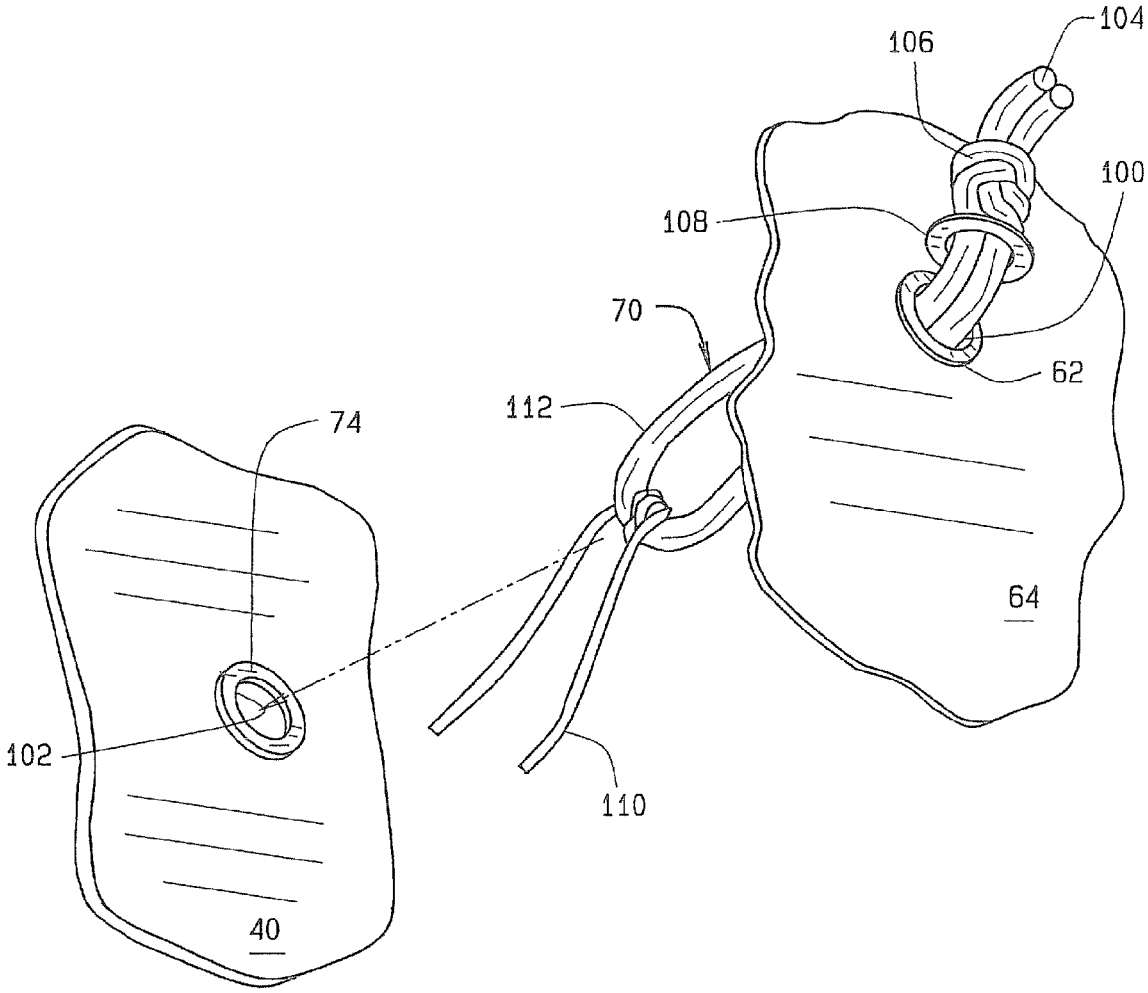
FIG. 6 is a perspective view of the loop in the outside portion of the front pocket and the corresponding grommet in the inside portion of the front pocket.
Figure 8A:
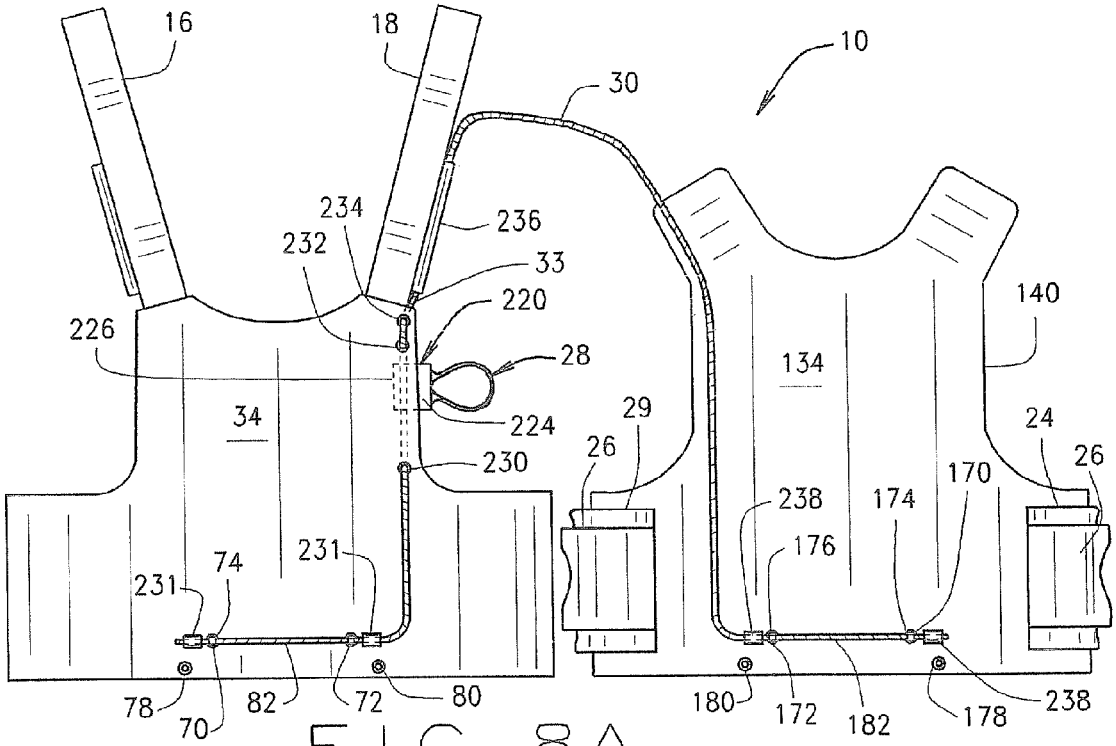
FIG. 8A is an exploded partial perspective view of the inside of the ballistic resistant vest showing the cable in the closed position to secure the front armor plate in the front pocket and the rear armor plate in the rear pocket.
Figure 8B:
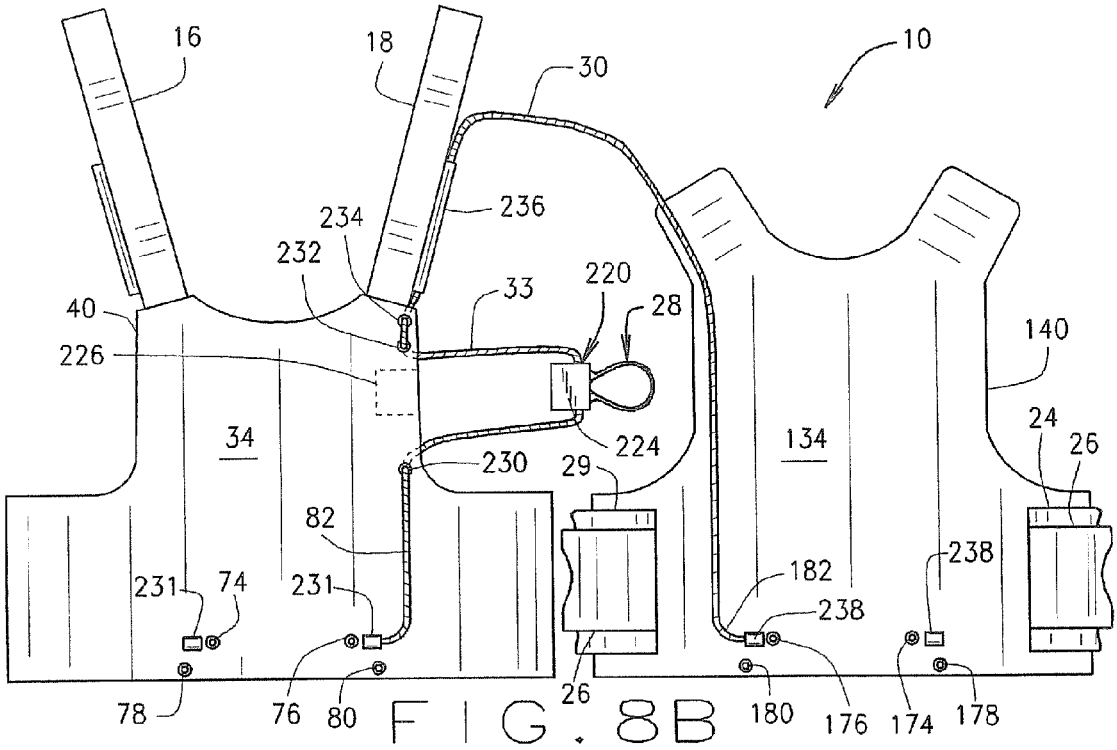
FIG. 8B is an exploded partial perspective view of the outside of the ballistic resistant vest showing the cable in the open position to at least partially free the front armor plate and the rear armor plate to slip out of the vest.

The cable 30 passes through several grommets, including grommets 230, 232, and 234, better seen in FIGS. 2, 8A and 8B. The grommets 230, 232 and 234 can be the same size and configuration as the grommets 74, 76, 78, 80, 174, 176, 178, and 180. FIG. 6 shows an enlargement of the grommet 74 and the hole 102. The diameter of the hole 102 and the holes in all the other grommets are preferably about ¼ inch although they may be of other diameters. The diameter of the holes in the grommets 230, 232 and 234 is large enough to permit easy movement of the cable 30 through the holes 102. For manufacturing convenience, the same size grommets with a common hole diameter are used throughout the entire ballistic resistant vest 10. Other hole sizes may be suitable as long as they permit the cable 30 to easily slip through the holes 102 of the grommets when the release handle 28 is pulled, as will be discussed more thoroughly below.

Figure 3A:
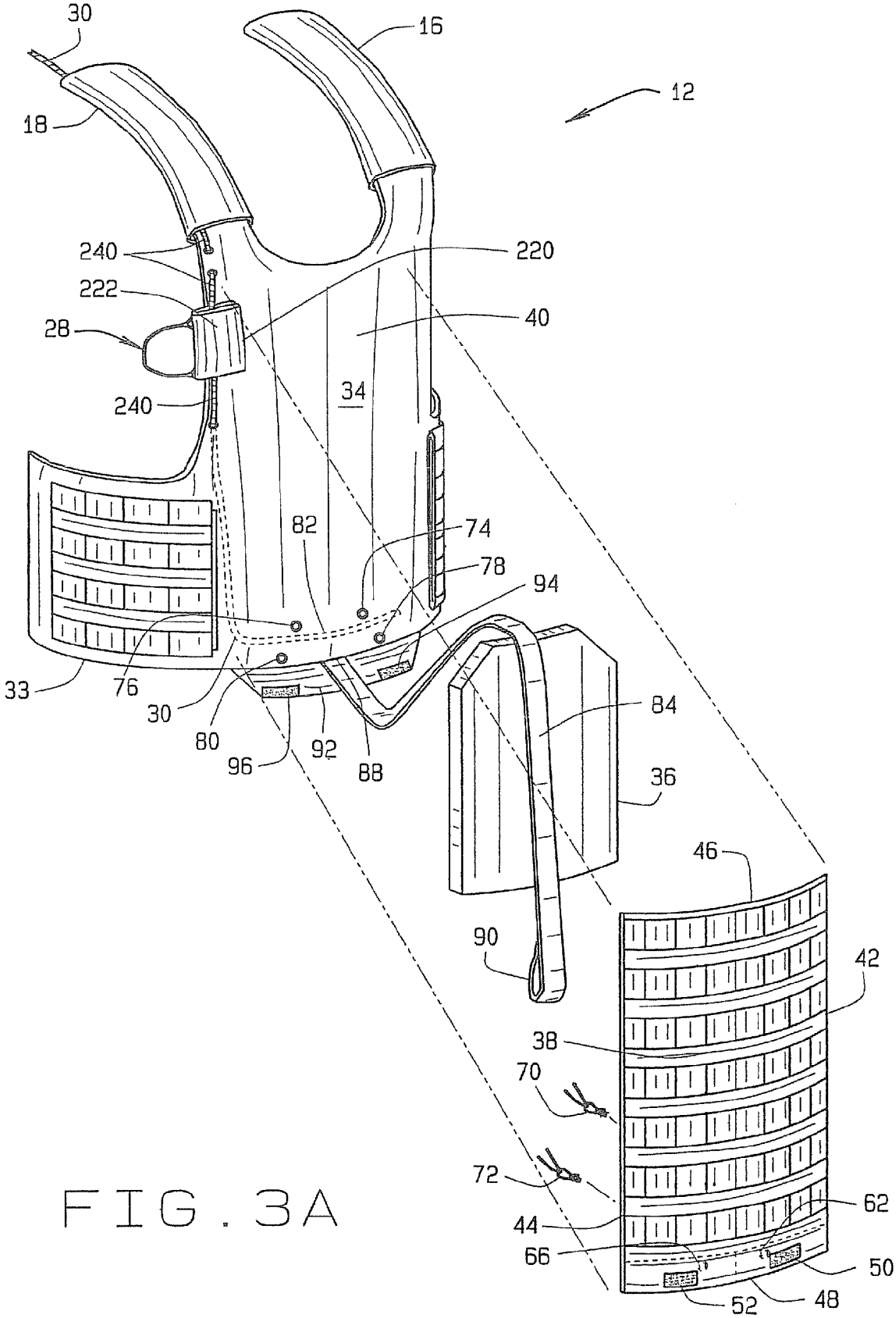
FIG. 3A is an exploded view of the front torso section, front pocket and the front armor plate viewed from the outside of the ballistic resistant vest.
Figure 3B:
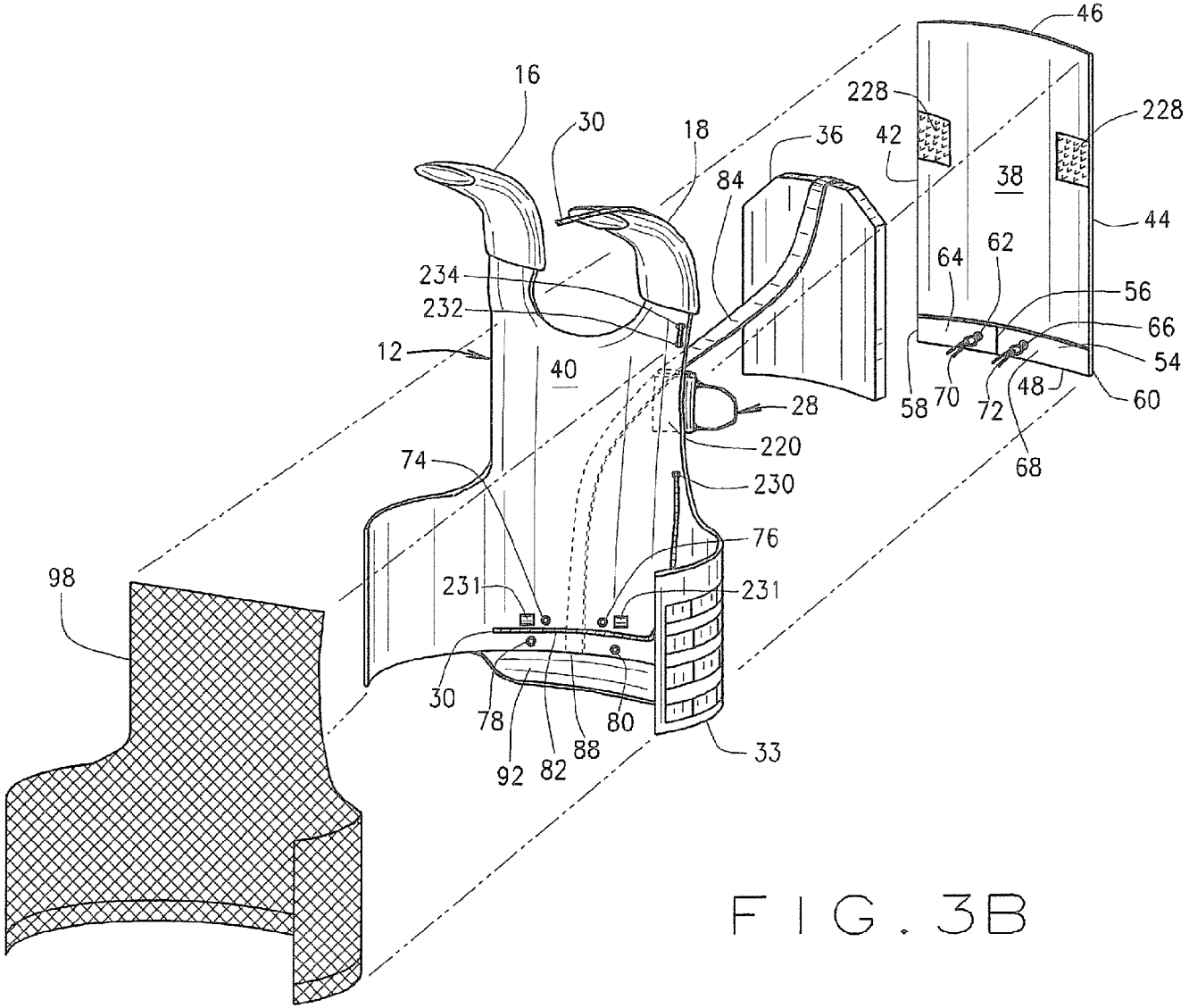
FIG. 3B is an exploded view of the front torso section, front pocket and the front armor plate viewed from the interior of the ballistic resistant vest, which is sometimes referred to as the "body" side.

FIGS. 3A and 3B are exploded views of the front torso section 12, a front pocket 34 and a front auxiliary armor plate 36. The armor plate 36, when used, makes the vest 10 ballistically resistant on the front side. In FIG. 3A, the front torso section 12 is viewed from the outside of the vest, sometimes referred to as the "impact" side. In FIG. 3B the front torso section 12 is viewed from the inside of the vest, sometimes referred to as the "body" side of the vest. The front pocket 34 is defined by a front outside panel portion 38 which connects to an inside panel portion 40. The outside panel portion 38 has a left side edge 42, a right side edge 44, a top edge 46, a bottom edge 48, a left outside panel fastener 50 and a right outside panel fastener 52. The front outside panel portion 38 is connected to the front inside panel portion 40 by stitching or other fastening means along at least the left side edge 42 and the right side edge 44. In one embodiment, the outside panel 38 is connected to the inside panel 40 along three edges, the left side edge 42, the top edge 46 and the right side edge 14 to define the bottom opening 86 of the rear front pocket 34, as better seen in FIGS. 4A, 4B and 5.

A hem section 54 of the front outside panel portion 38 is folded back against an inside surface of the outside panel along the bottom edge 48 and is stitched at a mid-seam 56, a left side seam 58 and a right side seam 60. A left front outside grommet 62 is positioned in the left portion 64 of the hem section 54 and a right front outside grommet 66 is positioned in the right portion 68 of the hem section 54 of the front outside panel portion 38. Each grommet described herein defines a through hole 102 as better seen in FIG. 6.

A retainer mechanism preferably in the form of one or more connector elements such as a left front loop assembly 70 passes through the left front outside grommet 62 and a right front loop assembly 72 passes through the right front outside grommet 66. A left front inside grommet 74 and a right front inside grommet 76 are positioned in the inside panel portion 40. The hole in the left outside grommet 62 is aligned with the hole in the left front inside grommet 74 and the hole in the right outside grommet 66 is aligned with the hole in the right front inside grommet 76. A left drain grommet 78 and a right front drain grommet 80 are positioned in the inside panel portion 40 to drain the pocket 34. The purpose of the drain grommets is to allow water to exit the front pocket 34 during rainstorms and other wet situations, especially when the front pocket is in the closed condition of FIG. 4A.

Figure 4A:
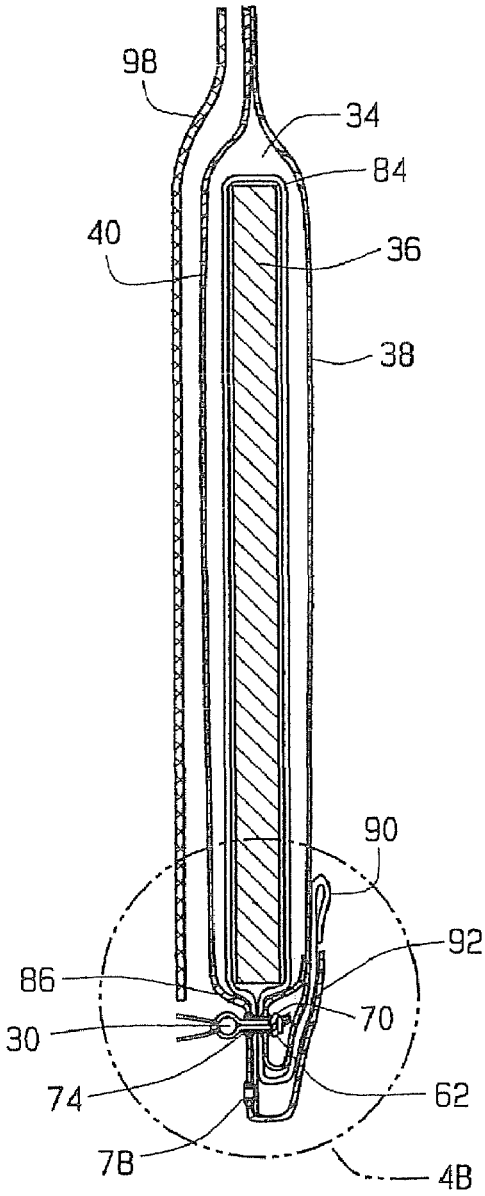
FIG. 4A is a partial section view of the front pocket with the pull strap and the armor plate secured therein.

The left front grommet 62 receives the left front loop assembly 70. The right front grommet 66 receives the right front loop assembly 72. The flexible elongate cable 30 has a front positioned free end portion 82 that engages the loop assemblies 70 and 72, on the inside or body side of the front torso section 12, to close the front pocket 34 and retain the front auxiliary armor plate 32 in the vest 10 as seen in FIG. 4A. When the user pulls the release handle 28, the front end portion 82 disengages from the front loop assemblies 70 and 72 allowing the front armor plate 36 to be freed to slip out of the front pocket 34 by gravity when the user is properly oriented to take advantage of gravity for ejecting plate 36. When the loops 70, 72 are released by pulling the handle 28 and disengaging the cable 30 therefrom, the loops no longer retain the plate 36 freeing it to exit the pocket 34 through the opening 86 as more fully described below. However, in emergency situations, the user may be in the water and gravity may not on its own cause the armor plate 36 to slip out of the front pocket 34. A front ejection strap 84 is provided to ensure positive manual ejection of the front armor plate 36 from the front pocket 34, if necessary.

Figure 5:
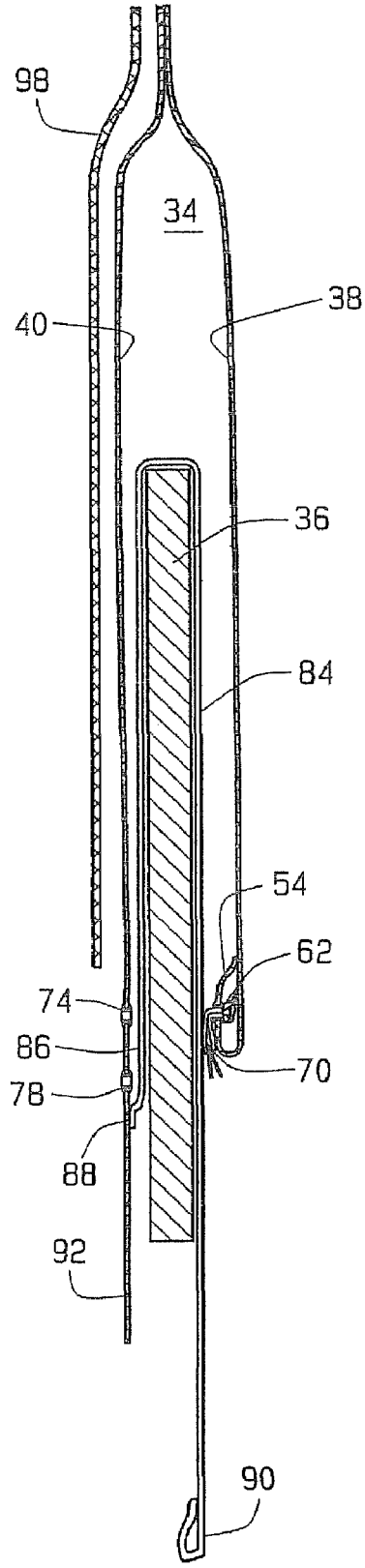
FIG. 5 is a partial section view of the front pocket of FIG. 4A with the armor plate slipping out of the front pocket.
Figure 4B:
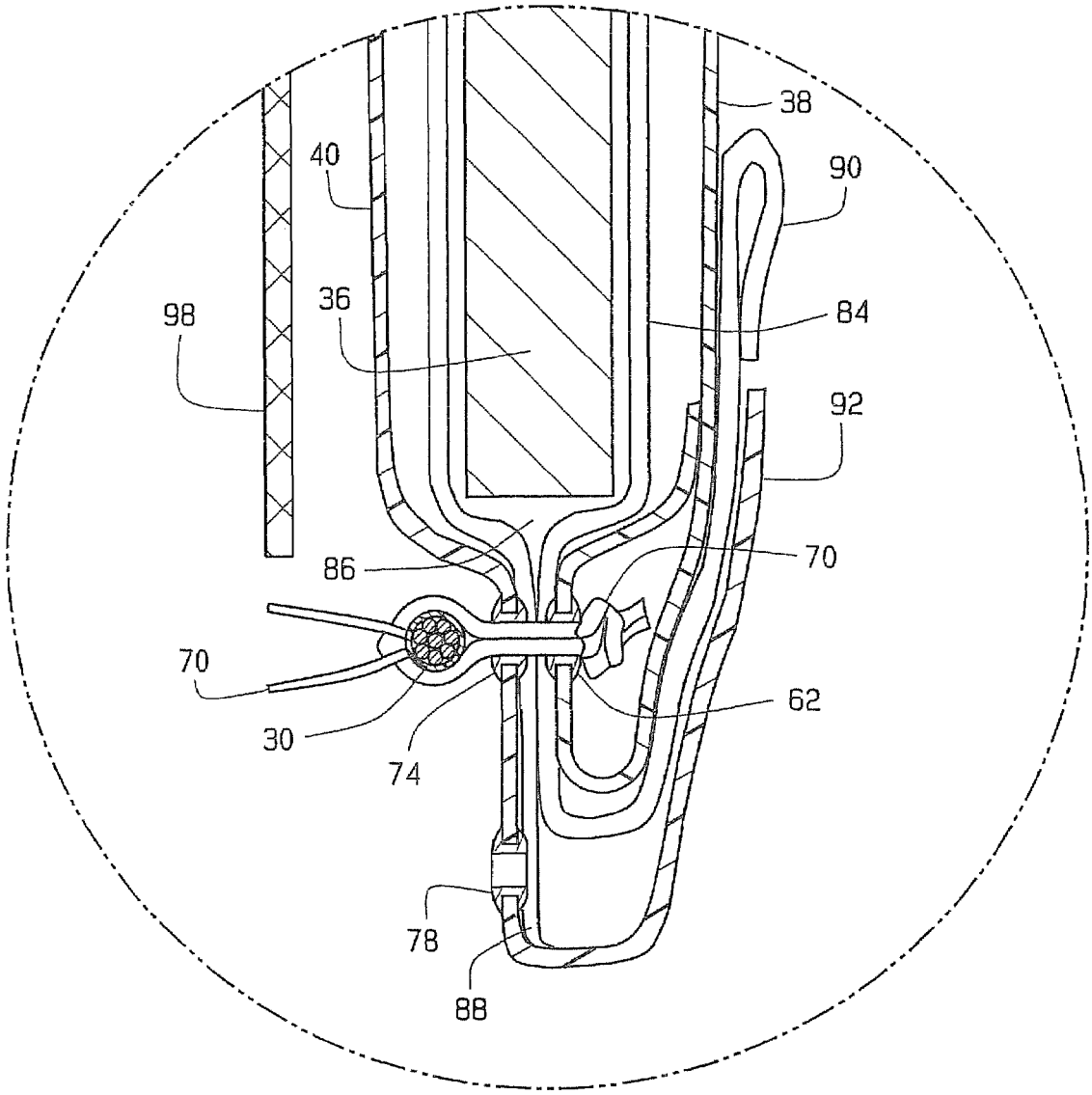
FIG. 4B is an enlarged view of a portion of the front pocket of FIG. 4A as circled by the line 4B.

There is an opening between the bottom edge 48 of the outside panel portion 38 and the inside panel portion 40 which will be referred to as the front gate opening 86 as better seen in FIGS. 4A, 4B and 5. The loops 70, 72 are used to selectively bridge the opening 86 and provide a gate to retain the plate 36 in the pocket 34. This opening 86 in the front pocket 34 allows the front armor plate 36 to be inserted into the front pocket, and when desired, removed from the front pocket. The front ejection strap 84 is secured on a proximal end 88 to the rear inside panel portion 40. The other end 90 of the front ejection strap is unsecured. The front ejection strap 84 may be looped around the front armor plate as generally shown in FIGS. 3A, 3B, 4A, 4B and 5.

Proximate the opening 86, a bottom flap 92 is shown as secured along one edge to the inside front panel portion 40. A left inside fastener 94 and a right inside fastener 96 are attached to the bottom flap 92. The left inside fastener 94 is arranged to engage the left outside fastener 50 and the right inside fastener 96 is arranged to engage the right outside fastener 52. This allows the bottom flap 92 to assist in additionally closing the opening 86. When the release handle 28 is pulled and the vest 10 is oriented to take advantage of gravity, the weight of the armor plate typically overcomes the gripping attachment of the fasteners 50, 94, 52 and 96. The bottom flap 92 is optional and if the flap 92 does not disengage from the gripping attachment of the fasteners 50, 94, 52 and 96 when the release handle 28 is pulled due to the weight of the armor plate, manual ejection of the armor plate 36 may be achieved by pulling the strap 84 as will be hereinafter explained. An inside front mesh panel 98 is also shown as attached to the inside panel portion 40 so the mesh panel 98 is proximate the user of the vest 10. In the industry, the mesh panel 98 is affixed to the "body" side of the vest and is intended to face the body of the user.

FIG. 4A is a section view of the front pocket 34 with the opening 86 closed by the loops 70, 72 and cable 30 securing the front armor plate 36 in the front pocket 34. FIG. 4B is an enlargement of the front opening 86 showing the left front loop assembly 70 in engagement with the cable 30 bridging the opening. The left front loop assembly 70 is held in place by the left front outside grommet 62 and passes through the left front inside grommet 74 to engage the cable 30 on the inside or body side of the front torso section 12 to releasably retain the front armor plate 36 in the front pocket 34 of the vest 10. The secured end 88 of the front ejection strap 84 is stitched or otherwise attached to the inside panel portion 40. The front ejection strap 84 loops around the front armor plate and the free end 90 of the ejection strap protrudes outside the front pocket where it is easy to grasp to eject the front armor plate 36 from the front pocket 34, if necessary, after the release handle 28 has been pulled.

FIG. 5 is a section view of the front pocket 34 with the opening 86 and the loops 70, 72 in the open position and the front armor plate 36 exiting the front pocket. The user has pulled on the release handle 28 which disengages the free end portion 82 of the cable 30 from the front loop assemblies 70, 72 allowing the front loop assemblies to disengage from the holes 102 in the grommets 74, 76 to open the width of the opening 86. At this time, the armor plate 36 is at least partially freed to fall from the front pocket 34 by gravity. If the plate 36 does not fall from the pocket 34 when the release handle 28 is pulled, the user can grasp the free end 90 of the front ejection strap 84 and pull the armor plate 36 from the front pocket 34 if the flap 92 does not open under the weight of the armor plate 36.

FIG. 6 is an enlargement of the left front loop assembly 70 disengaged from the grommet 74. The left front loop assembly 70 and all the other loop assemblies associated with this invention may be formed the same for manufacturing convenience and to make the vest 10 easier to use. The use of two loop assemblies to close a pocket has been found to be effective, but more or less loop assemblies may also suffice. The opening 86 has its width reduced by use of one or more loop assemblies to a width less than the width of the armor plate 36. A cord 104 is tied upon itself into a knot 106 and may be passed through a ring 108. A string 110 may be tied on the loop section 112 to facilitate threading the loop section through the hole 102 in the grommet 74. The cord 104 may be elasticized. The front left outside grommet 62 is placed in the left portion 64 of the hem section 54 of the outside panel portion 38, better seen in FIG. 3B. The loop section 112 of the left front loop assembly 70 is placed through the hole 100 in the grommet 62. The string 110 is then easily threaded through the hole 102 in the grommet 74. The user can then pull the loop section 112 through the hole 102 in the grommet 62 to bridge and close the opening 86. The front free end portion 82 of the cable 30 can then be threaded through the loop section 112 of the left front loop assembly 70 and likewise through the loop assembly 72 to secure the gate in the closed position and retain the armor plate 36 in the front pocket as shown in FIGS. 4A and 4B. In an alternative embodiment not shown, the front loop assemblies 70, 72 can be secured to the hem section 54 of the outside panel portion 38 by sewing or other attachment means. All that is needed is that the loop section 112 be able to be fed through the holes 102 in the grommet 74, 76 so they can releasably engage the free end 82 of the cable 30.

The hole 102 has a diameter of about ¼ inch diameter, although it could be larger or smaller depending on the size of the loop assemblies 70, 72. The loop assemblies 70, 72 need to be able to pass through a respective hole 102 in the grommet.

Figure 7A:
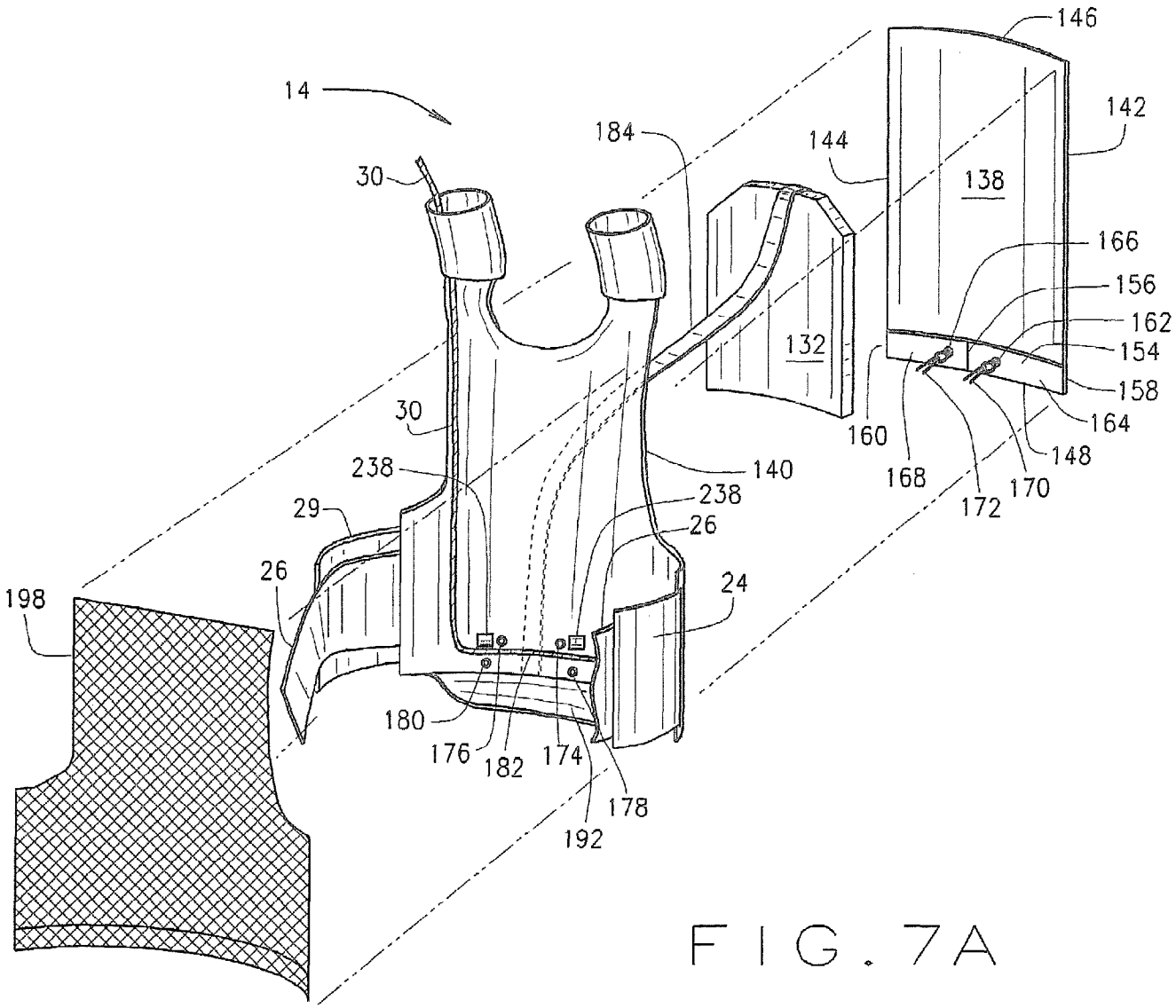
FIG. 7A is an exploded view of the rear torso section, rear pocket and the rear armor plate viewed from the inside of the ballistic resistant vest, which is sometimes referred to as the "body" side.
Figure 7B:
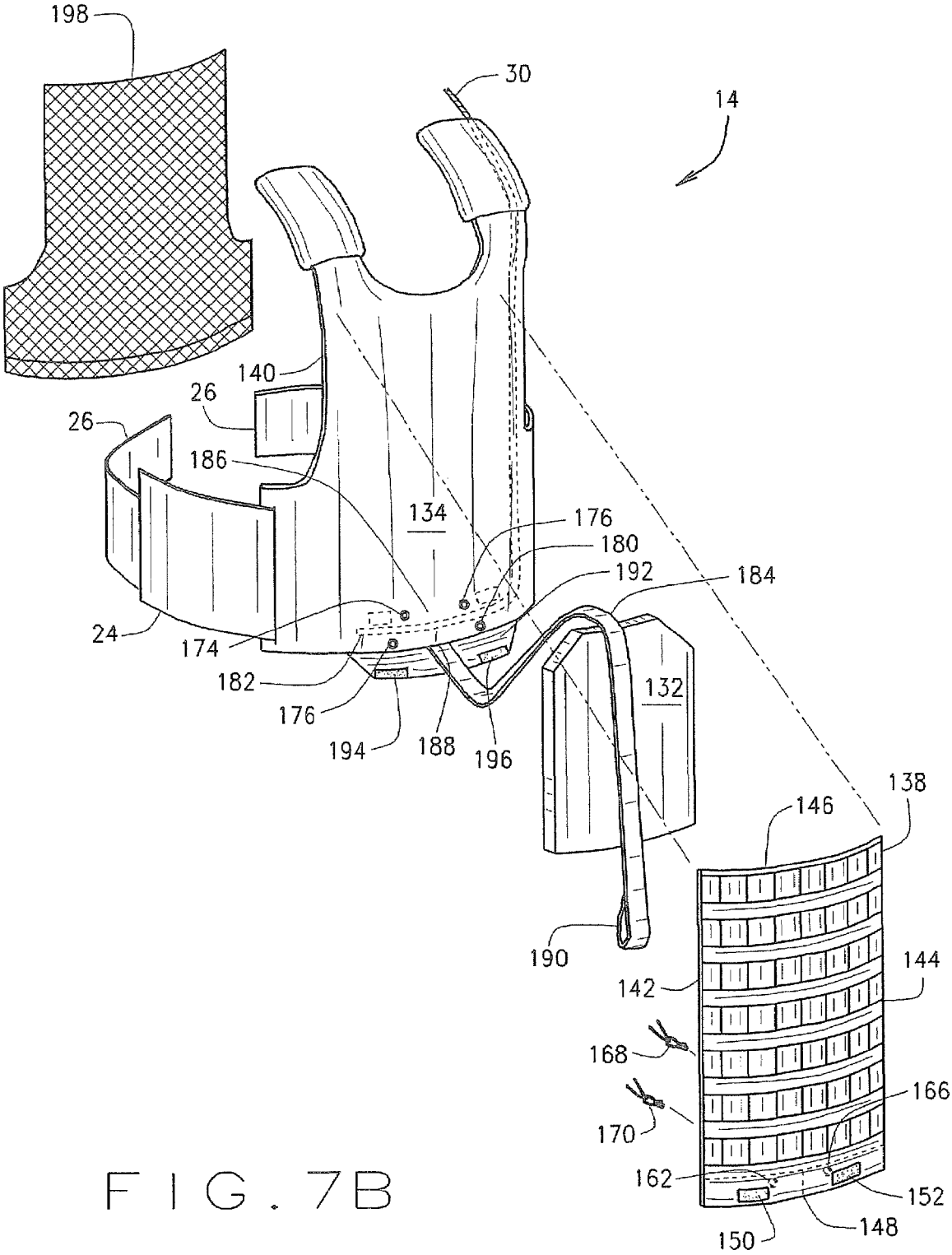
FIG. 7B is an exploded view of the rear torso section, rear pocket and the rear armor plate viewed from the outside of the ballistic resistant vest.

FIGS. 7A and 7B are exploded views of the rear torso section 14, a rear pocket 134 and a rear armor plate 132. The plate 132 is optional and when used, provides ballistic resistance. FIG. 7A is an exploded view of the rear torso section 14, and the rear armor plate 132 viewed from the interior of the vest 10, sometimes referred to as the "body" side. In FIG. 7B the torso section 14 is viewed from the outside of the vest 10, sometimes referred to as the "impact" side. The rear pocket 134 is defined by a rear outside panel portion 138 which connects to an inside panel portion 140. The outside panel portion 138 has a left side edge 142, a right side edge 144, a top edge 146, a bottom edge 148, a left outside panel fastener 150 and a right outside panel fastener 152. The rear outside panel portion 138 is connected to the rear inside panel portion 140 by stitching or other fastening means along at least the left side edge 142 and the right side edge 144. In one embodiment, the outside panel 138 is connected to the inside panel 140 along three edges, the left side edge 142, the top edge 146 and the right side edge 144 to define the bottom opening 186 of the rear pocket 134.

A hem section 154 of the rear outside panel portion 138 is folded back against the outside panel along the bottom edge 148 and is stitched at a mid-seam 156, a left side seam 158 and a right side seam 160. A left rear outside grommet 162 is positioned in the left portion 164 of the hem section 154 and a right rear outside grommet 166 is positioned in the right portion 168 of the hem section 154 of the rear outside panel portion 138. Each grommet described herein defines a hole 102, as better seen in FIG. 6. Retainer mechanisms in the form of one or more connector elements such as a left rear loop assembly 170 passes through the left front outside grommet 162 and a right rear loop assembly 172 passes through the right front outside grommet 166. A left rear inside grommet 174 and a right rear inside grommet 176 are positioned in the inside panel portion 140. The left outside grommet 162 is aligned with the left rear inside grommet 174 and the right outside grommet 166 is aligned with the right rear inside grommet 176. A left rear drain grommet 178 and a right rear drain grommet 180 are positioned in the inside panel portion 140 to drain the rear pocket 134. The purpose of the drain grommets is to allow water to exit the rear pocket 134 during rainstorms and other wet situations.

The left rear grommet 162 receives the left rear loop assembly 170. The right rear grommet 166 receives the right rear loop assembly 172. The flexible elongate cable 30 has a rear free end portion 182 on the inside or body side of the rear torso section 14 that engages the loop assemblies 170 and 172 at least partially to bridge the opening 186 to close the rear pocket 134 and retain the rear armor plate 132 in the vest 10. When the user pulls the release handle 28, the rear free end portion 182 disengages from the rear loop assemblies 170 and 172 at least partially freeing the rear armor plate 132 of support to slip out of the rear pocket 134 (as does the armor plate 36) through the opening 186 by gravity when the user is properly oriented to take advantage of the force of gravity. However, in emergency situations, the user may be in the water and gravity may not aid in causing the auxiliary armor plate to slip out of the rear pocket 134. A rear ejection strap 184 is provided to ensure positive manual ejection of the rear armor plate from the rear pocket 134.

There is an opening 186 between the bottom edge 148 of the outside panel portion 138 and the inside panel portion 140 for which the loop assemblies 170 and 172 along with the cable 30 form a rear gate by bridging the opening 186. The opening 186 has its width reduced by use of one or more loop assemblies to a width less than the width of the armor plate 132. This opening in the rear pocket allows the rear armor plate 132 to be inserted into the rear pocket 134 and, when necessary, removed from the rear pocket. The rear ejection strap 184 is secured on a proximal end 188 to the rear inside panel portion 140. The distal end 190 of the rear ejection strap is unsecured. The rear ejection strap 184 is looped around the rear armor plate 132 as generally shown in FIGS. 7A and 7B.

Proximate the opening 186 is an optional bottom flap 192 (like the optional flap 92 described above) secured to the inside rear panel portion 140 along one edge. A left inside fastener 194 and a right inside fastener 196 are attached to the bottom flap 192. The left inside fastener 194 is arranged to engage the left outside fastener 150 and the right inside fastener 196 is arranged to engage the right outside fastener 152. This allows the bottom flap 192 to cover the opening 186. An inside rear mesh panel 198 is attached to the inside panel portion 140 so the mesh panel 198 is proximate the user of the vest. The mesh panel 198 is affixed to the "body" side of the vest and is intended to face the body of the user. Like the bottom flap 92, if the flap 192 does not disengage from its corresponding attachment means due to the weight of the armor plate 132 when the release handle 28 is pulled, manual ejection of the armor plate 132 can again be achieved by pulling the strap 184.

FIG. 8A is an exploded partial perspective view of the inside of the vest 10 showing the cable 30 in the closed position to secure the front armor plate 36 in the front pocket 34 and the rear armor plate 132 in the rear pocket 134. FIG. 8B is an exploded partial perspective view of the outside of the vest 10 showing the cable 30 in the release condition to open the respective pockets and allow the front armor plate 36 and the rear armor plate 132 to slip out of the vest.

The release handle 28 includes an attaching assembly 220 including a front attaching element 222 and a rear attaching element 224. The rear attaching element 224 engages a panel attaching element 226, shown in phantom, on the front inside panel portion 40. The front attaching element 222 engages one of two panel attaching elements 228 on the front outside panel portion 38 as best shown in FIG. 3B depending upon which side the release handle 28 is located. These attaching elements can be formed from Velcro®(D fasteners, snaps, and other types of quick release fasteners.

When the user pulls the release handle 28 as shown in FIG. 8B, the front free end portion 82 of the cable 30 is pulled out of engagement with the loop assemblies 70 and 72 and the rear free end portion 182 of the cable 30 is pulled out of engagement with the loop assemblies 170 and 172. This allows the loop assemblies 70, 72, 170 and 172 to pass through the grommets 74, 76, 174 and 176 opening the gates for the opening 86 and the opening 186 at least partially freeing the front armor plate 36 and the rear armor plate 132 to exit the front and rear pockets 34 and 134.

The cable 30 is secured to the attaching assembly 220 which is a part of the release handle 28. The cable 30 runs from the attaching assembly through a grommet 230, through one or more front guides 231, allowing the front free end 82 to be in proximity to the grommets 74 and 76 to engage the loop assemblies 70 and 72 as shown in FIG. 8A. In the other direction, the cable 30 runs from the attaching assembly through a grommet 232 and another grommet 234, through a guide 236 in the shoulder strap 18, through one or more rear guides 238, allowing the rear free end 182 to be in proximity to the grommets 174 and 176 to engage the loop assemblies 170 and 172 as shown in FIG. 8A. The position of the cable 30 and the free end portions 82 and 182 described above and shown in FIG. 8A is referred to as the "closed" position because the gating of the opening 86 and opening 186 is closed and the armor plates 34 an 134 are secured in the front and rear pockets of the vest respectively. The closed position may also be referred to as the secure position.

The position of the cable 30 and the free end positions 82 and 182 shown in FIG. 5B is referred to as the "open" or "release" position because the opening 86 and the opening 186 are open and the armor plates can slip out of the front and rear pockets of the vest.

Referring now to FIGS. 3B and 7A, the front free end 82 of the cable 30 runs between the inside front mesh panel 98 and the inside panel portion 40 which is often referred to as the "body" side of the vest. However, as seen in FIGS. 1 and 3A, an exposed cable portion 240 of the cable 30 is positioned on the "impact" side of the panel 40. The fact that the front free end 82 is on one side of the panel portion 40 and the exposed cable portion 240 is on the opposite side of the panel portion 40 allows for a more positive and definite disengagement of the front free end 82 from the front loop assemblies 70 and 72 when the release handle 28 is pulled.

Referring now to FIG. 7A, the free end portion 182 of the cable 30 runs between the inside rear mesh panel 198 and the inside panel portion 140 which is often referred to as the "body" side of the vest. The free end portion 182 passes through one or more guides 238 allowing the free end portion 182 to be positioned in proximity to the grommets 174 and 176 in order to engage the rear loop assemblies 170 and 172.

FIGS. 8A and 8B show a single cable 30 having a front free end portion 82 and a rear free end portion 182. The front free end portion 82 of cable 30 is disposed on the "body" side of the front torso section 12; likewise the rear free end portion 182 of the cable 30 is disposed on the body side of the rear torso section 14. The release handle 28 is located proximate an upper portion of the front armor plate 36, as better seen in FIGS. 1 and 2, on the "impact" side of the front torso section. When the release handle 28 is pulled the free end portion 82 and the free end portion 182 disengage respectively from the front loop assemblies 70 and 72 and the rear loop assemblies 170 and 172, unlike prior art designs such as the DAP vest. Depending on the length of the cable portions 82, 182, the release of the plates 36, 132 may be concurrent or at least substantially concurrent. After a vest has be worn a few weeks, the fasteners 50, 52, 94 and 96 for the bottom flap 92 may become worn and when wet, often pop open under the weight of an armor plate when the front loop assemblies 70 and 72 have been disengaged and the gate is in the "open" position. In other words, it is seldom necessary to use the front ejection strap 84 when the gate is in the "open" position, as long as the vest is properly oriented so gravity can be relied upon to assist in pulling the front auxiliary armor plate out of the front pocket. The same is likewise true for the rear auxiliary armor plate and the rear pocket. Obviously if the user is upside down in the water and sinking, or if the flaps 92 and 192 do not fully open when the release handle 28 is pulled, the front ejection strap 84 and the rear ejection strap 184 can be pulled to eject the armor plates out of the pockets. However, in most emergency situations, the user is in a position where the user's head is in an upright position in the water because of a personal flotation device, so that gravity can be relied upon to pull the armor plates out of the vest, once the release handle has been pulled.

Although the release handle 28 and associated flexible cable 30 are disclosed herein as being associated with the right side of the vest 10 near the right shoulder strap, it is recognized and anticipated that the release handle 28 and the associated cable 30 can be positioned, located and routed on the left side of the vest 10 near the left shoulder portion, and it is also recognized and anticipated that the present release handle, cable and system can be positioned, located, and routed anywhere on the vest 10 depending upon certain tactical necessities and applications, and depending upon whether the user is right handed or left handed, including routing the flexible cable 30 around the side portions of the vest depending upon the particular type and construction of the vest involved. In this regard, it is recognized that the present release system can be utilized in association with any vest or outer garment regardless of its construction, wherein armor plates or other objects need to be placed adjacent the garment. Such vest may or may not include a cummerbund portion as described above; such vest may or may not include an inner and/or outer belt portion as referenced above; such vest may open from one side portion only; such vest may open from the front center portion thereof; or such vest may be made as a one piece unit and dawned by slipping the vest over the head and shoulders of a particular user. In addition, the specific construction of any cummerbund, inner and/or outer belts, and the shoulder straps associated with any particular vest may vary widely, if used, without departing from the spirit and scope of the present invention. The specific construction of the vest or other outer garment is not important to the construction and operation of the present release system described herein. The present invention is not limited to the specific vest 10 disclosed herein but instead is directed to the release system for releasing the armor plates from the vest. The construction of the vest 10 as described above is for illustrative purposes only and still other variations and different constructions associated with a particular vest or other outer garment are envisioned and contemplated and the present release system can be used and/or adapted for use in association with any of these different types of garments.

Still further, it is also recognized and anticipated that the pockets 34 and 134 may not be formed by substantially solid or continuous inner and outer fabric panel portions such as the panel portions 38 and 40 illustrated in FIG. 3A and FIG. 3B, but that such pockets may be defined by at least one of such inner and/or outer panels being formed of one or more straps which are positioned and located so as to receive and capture a front or rear armor plate when positioned therewithin, the strap or plurality of straps being used as the outside or inside panel portion such as the panel portions 38 and 40 referenced above. Still other variations and combinations of various members and other components may be utilized to form the referenced front and rear pockets.

Still further, it is recognized and anticipated that the flaps 92 and 192 are optional and that a vest or other outer garment can be made without using such flaps. In this situation, the free end portions 82 and 182 of the flexible cable 30 in conjunction with the front and rear loop assemblies 70, 72, 170 and 172 form the gating or closure mechanism for retaining the respective armor plates within the front and rear pockets 34 and 134. Likewise, it is recognized and anticipated that the cable guides 231, 236 and 238 can be positioned anywhere on the vest or outer garment to properly locate the cable 30 for operative use.

Still further, although the present release system has been described using a particular construction associated with the front and rear connector elements such as loop members passing through holes or openings associated with a particular grommet, it is recognized and anticipated that a wide variety of other connector elements may be utilized in association with the flexible cable or flexible retainer element so as to achieve a quick release of the armor plates or the other objects associated with a particular garment when the release handle is pulled. It is also recognized that the overall dimensions of the present system and assembly as well as the specific shape and configuration of the various members associated therewith are also subject to wide variations and may be sized and shaped into a variety of different sizes and configurations so as to be compatible with the particular garment and/or application involved. All such changes and modifications can be accomplished without impairing the teachings and practice of the disclosed structure and method.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A vest having a quick release system for a front armor plate and a rear armor plate comprising:

a front torso section having a front pocket with a bottom opening to selectively carry a front armor plate;

a rear torso section connected to the front torso section, the rear torso section having a rear pocket with a bottom opening to selectively carry a rear armor plate;

at least one front connector element to selectively bridge the front pocket bottom opening and assist in selectively retaining a front armor plate in the front pocket and at least one rear connector element to selectively bridge the rear pocket bottom opening and assist in selectively retaining a rear armor plate in the rear pocket; and a retainer system having a flexible retainer element with a first portion for selectively retaining the front connector element bridging the front pocket bottom opening and a second portion for selectively retaining the rear connector element bridging the rear pocket bottom opening and to selectively release the front and rear connector elements from their bridging configuration and thereby open both the front and the rear pockets to free a front armor plate to exit the front pocket and to free a rear armor plate to exit the rear pocket, said retainer system including a handle connected to the retainer element for simultaneously moving the first and second retainer element portions.

2. The vest of claim 1 wherein the flexible retainer element is including a single flexible cable carried by the front torso section, the rear torso section and a shoulder strap, the flexible cable having the handle secured thereto to pull the flexible cable out of engagement with the at least one front connector element and the at least one rear connector element.

3. The vest of claim 2 wherein the at least one front connector element including at least one front loop member to selectively bridge the front pocket bottom opening and engage the cable and wherein the at least one rear connector element including at least one rear loop member to selectively bridge the rear pocket bottom opening and engage the cable.

4. A vest having a quick release system for an armor plate comprising:

a first torso section having a first pocket sized and arranged to receive an armor plate, said first pocket having an outside portion and an inside portion and a bottom opening;

at least one loop member operatively connected to the outside portion of the first pocket, the loop member passing through at least one hole in the inside portion of the first pocket to selectively bridge the bottom opening of the front pocket and adapted to selectively retain an armor plate in the first pocket;

a flexible elongate cable having at least one free end portion, a portion of the at least one free end portion of said cable being threaded through the at least one loop member to selectively secure the at least one loop member in place to selectively bridge the bottom opening of the first pocket and for selectively retaining an armor plate in the first pocket, the at least one free end portion of said cable being positioned on a body side of the inside portion of the first pocket; and a release handle attached to the flexible elongate cable to facilitate pulling the at least one free end portion of the flexible elongate cable out of the at least one loop member for allowing an armor plate to exit the first pocket through the bottom opening.

5. The vest of claim 4 further including:

a second torso section having a second pocket sized and arranged to receive an armor plate, said second pocket having an outside portion and an inside portion and a bottom opening;

at least one loop member operatively connected to the outside portion of the second pocket, the loop member passing through at least one hole in the inside portion of the second pocket to selectively bridge the bottom opening of the second pocket and adapted to selectively retain an armor plate in the second pocket;

the flexible elongate cable having a second free end portion, a portion of the second free end portion of said cable being threaded through the at least one loop member to selectively secure the at least one loop member in place to selectively bridge the bottom opening of the second pocket and for selectively retaining an armor plate in the second pocket, the second free end portion of the cable being positioned on a body side of the inside portion of the second pocket; and said release handle being attached to the flexible elongate cable to further facilitate pulling the second free end portion of the flexible elongate cable out of the at least one loop member for allowing an armor plate to exit the second pocket through the second pocket bottom opening.

* * * * *